US009007873B2

(12) United States Patent
Yan et al.

(10) Patent No.: US 9,007,873 B2
(45) Date of Patent: Apr. 14, 2015

(54) CLAMP TYPE ULTRASONIC PROCESSOR AND APPLICATION THEREOF

(75) Inventors: Zhuosheng Yan, Guangdong (CN); Jinxuan Yan, Guangdong (CN); Zhuoli Yan, Guangdong (CN); Zhizhong Yang, Guangdong (CN); Qiang Ye, Guangdong (CN); Hui Cao, Guangdong (CN); Yanmiao He, Guangdong (CN)

(73) Assignee: Guangzhou Newpower Ultrasonic Electric Equipment Co., Ltd., Guangdong (CN)

( * ) Notice: Subject to any disclaimer, the term of this patent is extended or adjusted under 35 U.S.C. 154(b) by 435 days.

(21) Appl. No.: 13/576,398

(22) PCT Filed: Nov. 1, 2010

(86) PCT No.: PCT/CN2010/001741

§ 371 (c)(1),
(2), (4) Date: Aug. 1, 2012

(87) PCT Pub. No.: WO2011/094925

PCT Pub. Date: Aug. 11, 2011

(65) Prior Publication Data

US 2012/0300590 A1 Nov. 29, 2012

(30) Foreign Application Priority Data

Feb. 5, 2010 (CN) ..... 2010 1 0109377

(51) Int. Cl.

| | |
|---|---|
| ***H04B 1/03*** | (2006.01) |
| ***B22D 1/00*** | (2006.01) |
| ***B22D 27/20*** | (2006.01) |

(52) U.S. Cl.
CPC . *B22D 1/00* (2013.01); *B22D 27/20* (2013.01)

(58) Field of Classification Search
CPC ..... B22D 27/20; B22D 1/00
USPC ..... 367/140
See application file for complete search history.

(56) References Cited

U.S. PATENT DOCUMENTS 5,159,580 A * 10/1992 Andersen et al. ..... 367/165
2012/0300590 A1* 11/2012 Yan et al. ..... 367/140

FOREIGN PATENT DOCUMENTS

CN 1807011 * 7/2006

* cited by examiner

*Primary Examiner* — Daniel Pihulic

(57) ABSTRACT

A clamp type ultrasonic processor comprises a transducer assembly and a functional gripper. The transducer assembly comprises a transducer (1) and an amplitude transforming shaft (2) attached thereto. At least one transducer assembly is connected to the functional gripper. The functional gripper comprises an irradiation front line shaft-approximal block (3) and an irradiation front line tube-supporting block (4), and a functional gripper chamber (8) is provided in the functional gripper for accommodating an ultrasonic irradiation receiver. The irradiation front line shaft-approximal block (3) and the irradiation front line tube-supporting block (4) are connected to grip tightly the ultrasonic irradiation receiver to be irradiated. Irradiation front line shaft-approximal block (3) and/or the irradiation front line tube-supporting block (4) are connected to the amplitude transforming shaft (2). An application of the clamp type ultrasonic processor and its application in metal production are also provided.

9 Claims, 8 Drawing Sheets

CLAMP TYPE ULTRASONIC PROCESSOR AND APPLICATION THEREOF

BACKGROUND OF THE INVENTION

The present invention relates to an ultrasonic processing apparatus, and more specifically relates to a clamp type ultrasonic processor and application thereof.

Currently, functional apparatus for ultrasonic cavitation, including those ultrasonic cleaning apparatus utilizing liquid phase as transfer agent, adopt a form of trough or tank as the structure of their ultrasonic irradiation receivers. However, if these apparatus have to process gas, liquid or mixture of gas, liquid and solid materials flowing in a tube, they would encounter unsolvable problems.

BRIEF SUMMARY OF THE INVENTION

An object of the present invention is to solve the problems now existing in the ultrasonic processing of gas, liquid or mixture of gas, liquid and solid materials. To attain the above object, the present invention provides a clamp type ultrasonic processor and application thereof. The present invention could significantly enhance the effect of ultrasonic processing, and it is not required to alter many aspects of the existing apparatus, and it could operate even without interrupting a continuous working status. Furthermore, technical features additionally provided to the existing apparatus according to the present invention require only a small amount of space.

A clamp type ultrasonic processor according to the present invention comprises a transducer assembly and a functional gripper; the transducer assembly comprises a transducer and an amplitude transformation shaft; the transducer and the amplitude transformation shaft are connected with each other; and at least one set of the transducer assembly is used and connected with the functional gripper.

The functional gripper may comprise an irradiation front line shaft-approximal block and an irradiation front line tube-supporting block; a functional gripper chamber is formed inside the irradiation front line shaft-approximal block and the irradiation front line tube-supporting block for accommodating an ultrasonic irradiation receiver; the irradiation front line shaft-approximal block and the irradiation front line tube-supporting block are clamped tightly to grip the ultrasonic irradiation receiver tightly; the irradiation front line shaft-approximal block is connected with the amplitude transformation shaft.

The amplitude transformation shaft and the irradiation front line shaft-approximal block are connected via a connection screw.

The irradiation front line shaft-approximal block and the irradiation front line tube-supporting block are connected and fixed with each other via at least one screw.

The functional gripper chamber formed by the irradiation front line shaft-approximal block and the irradiation front line tube-supporting block contact tightly and fit perfectly to be clamped against with an outer wall of the ultrasonic irradiation receiver.

A connecting part between the irradiation front line shaft-approximal block and the amplitude transformation shaft may adopt a flat, raised or sunken shape in order to achieve good resonance effect when connected with the amplitude transformation shaft.

Two or more of the amplitude transformation shafts may be provided; a screw is provided for connection between two amplitude transformation shafts; and a flange could also be provided at a connecting part between two amplitude transformation shafts for consolidation purpose.

The functional gripper may adopt a rectangular shape, a circular shape, an oval shape or a triangular shape etc. The functional gripper chamber formed inside the functional gripper may adopt a rectangular shape, a circular shape, an oval shape or a triangular shape etc. according to the shape of the ultrasonic irradiation receiver being clamped.

An application of a clamp type ultrasonic processor, in which at least one clamp type ultrasonic processor is provided on an outer wall of an ultrasonic irradiation receiver; and a functional gripper chamber formed by a functional gripper of the clamp type ultrasonic processor is clamped against an outer wall of the ultrasonic irradiation receiver.

An application of a clamp type ultrasonic processor in metal production, in which a graphite rod is used as a transfer agent of ultrasonic waves; one end of the graphite rod is immersed into molten metal liquid phase; at least one of the clamp type ultrasonic processor is provided on the graphite rod; and a functional gripper of the clamp type ultrasonic processor clamps at an outer wall of the graphite rod.

According to the present invention, an outer wall of an ultrasonic irradiation receiver to be processed by ultrasonic waves could be tightly fitted with and clamped against a functional gripper, wherein one, two or more sets of transducer assembly/assemblies that match(es) with the functional gripper and each comprising a transducer and an amplitude transformation shaft is/are disposed on the functional gripper. Accordingly, the transducer assembly and the ultrasonic irradiation receiver with flowing liquid phase, thick liquid materials and vaporized materials inside could be tightly connected as a whole, and continuous or pulse type ultrasonic irradiation could also be provided continuously towards the materials inside the receiver. As a result, ultrasonic irradiation function could be significantly enhanced. Furthermore, conventional existing apparatus could be technically improved and modified easily by additional features provided according to the present invention without altering many aspects of the existing apparatus and even without interrupting a continuous working status during a production process. Furthermore, the technical features additionally provided to the existing apparatus according to the present invention require only a small amount of space, and they are also easy to position. Therefore, the present invention provides a very practical apparatus for modification and application of ultrasonic processing.

DETAILED DESCRIPTION OF THE INVENTION

The clamp type ultrasonic processor and application thereof according to the present invention are described in detail below with reference to the accompanying drawings.

Figure 1:
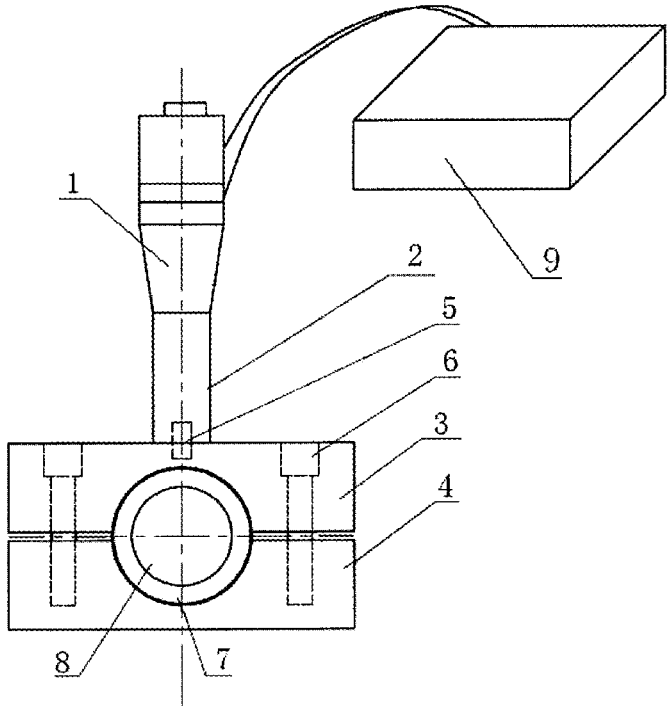
FIG. 1 is a structural view of the clamp type ultrasonic processor of the present invention.

As shown in FIG. 1, a clamp type ultrasonic processor comprises a transducer assembly and a functional gripper; the transducer assembly comprises a transducer 1 and an amplitude transformation shaft 2; the transducer 1 is connected with the amplitude transformation shaft 2; at least one set of the transducer assembly is used and connected with the functional gripper; the functional gripper may comprise an irradiation front line shaft-approximal block 3 and an irradiation front line tube-supporting block 4; a functional gripper chamber 8 is formed inside the irradiation front line shaft-approximal block 3 and the irradiation front line tube-supporting block 4 for accommodating an ultrasonic irradiation receiver; the irradiation front line shaft-approximal block 3 connects with the irradiation front line tube-supporting block 4 to grip the ultrasonic irradiation receiver tightly; the irradiation front line shaft-approximal block 3 and/or the irradiation front line tube-supporting block 4 is/are connected with the amplitude transformation shaft 2 via a connection screw 5; the transducer 1 may be piezoelectric type or magneto type; the transducer 1 and the amplitude transformation shaft 2 are connected via connection screws to form the transducer assembly; the transducer 1 is connected with an electrical ultrasonic wave emission apparatus 9 via a wire; ultrasonic waves generated by the electrical ultrasonic wave emission apparatus 9 irradiate into the ultrasonic irradiation receiver via the functional gripper, resulting in significant enhancement of ultrasonic function; the functional gripper is formed by assembling the irradiation front line shaft-approximal block 3 and the irradiation front line tube-supporting block 4 through tightening screws; the irradiation front line shaft-approximal block 3 is connected with the amplitude transformation shaft 2 by tightening the connection screw 5, so that the functional gripper and the transducer assembly is tightly connected as a whole; a tightening ring 7 is correspondingly disposed inside the functional gripper chamber formed by the functional gripper, so that the functional gripper and the ultrasonic irradiation receiver in the functional gripper chamber could be gripped tightly against each other and attached seamlessly with each other. The functional gripper is an important component for technical advancement of the clamp type ultrasonic processor. The functional gripper is preferred to be made of metals or alloy with hardness and tenacity properly adjusted by material treatments, or otherwise other rigid materials, for resonance and collection of ultrasonic energy which then smoothly and directly irradiates into the ultrasonic irradiation receiver so that functional effect of ultrasonic irradiation could be significantly enhanced.

Figure 2:
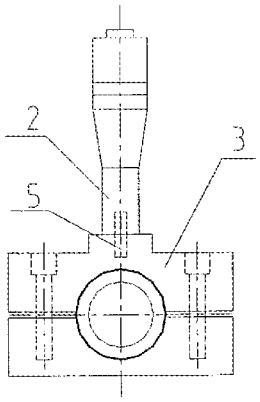
FIGS. 2-4 are structural views showing different connections between an amplitude transformation shaft and an irradiation front line shaft-approximal block and an irradiation front line tube-supporting block through a connection screw according to the clamp type ultrasonic processor of the present invention.
Figure 3:
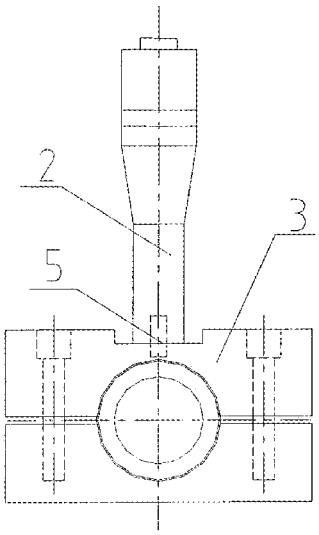
Figure 4:
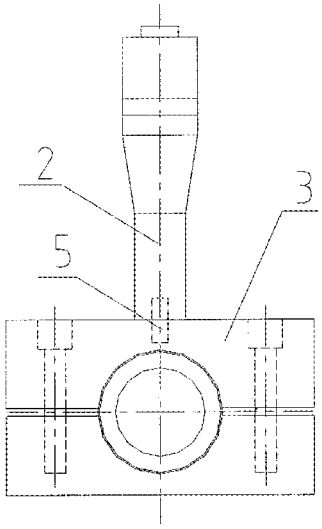

Basic structural formation of the functional griper of the clamp type ultrasonic processor should be highly adaptable to different sizes of ultrasonic irradiation receivers to which it is acted upon, and it should therefore subject to corresponding structural adaptation. The principle of adaptation lies in prioritizing the effect of resonance. As shown in FIG. 2, at a contact part where the amplitude transformation shaft 2 and the irradiation front line shaft-approximal block 3 and/or irradiation front line tube-supporting block 4 are connected via the connection screw 5 is configured in a shape of a raised platform. As shown in FIG. 3, a contact part where the amplitude transformation shaft 2 and the irradiation front line shaft-approximal block 3 and/or irradiation front line tube-supporting block 4 are connected via the connection screw 5 is configured as a sunken platform. As shown in FIG. 4, a contact part where the amplitude transformation shaft 2 and the irradiation front line shaft-approximal block 3 and/or irradiation front line tube-supporting block 4 are connected via the connection screw 5 is configured as a flat platform.

Figure 5:
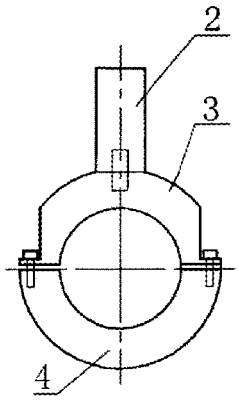
FIGS. 5-7 are structural views showing different shapes of a functional gripper according to the clamp type ultrasonic processor of the present invention.
Figure 6:
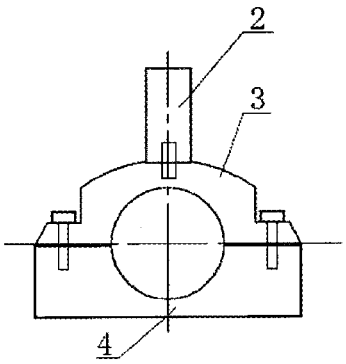
Figure 7:
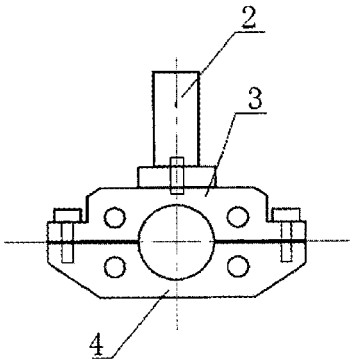

In view of steric hindrance resulted from the overall disposition of the functional gripper and the ultrasonic irradiation receiver that requires processing, and in view of the prioritization of resonance, the irradiation front line shaft-approximal block 3 and irradiation front line tube-supporting block 4 of the functional gripper could be made correspondingly in different shapes. The functional gripper could adopt a rectangular shape, a circular shape, a ring shape, a circular short chain shape, an oval shape, a triangular shape or a circular truncated cone shape etc. As shown in FIG. 5, both the irradiation front line shaft-approximal block 3 and the irradiation front line tube-supporting block 4 are made into semi-circular shape or semi-oval shape. As shown in FIG. 6, the irradiation front line shaft-approximal block 3 is made into semi-circular shape or semi-oval shape, while the irradiation front line tube-supporting block 4 is made into rectangular shape or square shape. As shown in FIG. 7, both the irradiation front line shaft-approximal block 3 and the irradiation front line tube-supporting block 4 are made into rectangular shape, square shape or trapezium shape. The irradiation front line shaft-approximal block 3 and the irradiation front line tube-supporting block 4 have the same or different various polygonal shapes.

The irradiation front line shaft-approximal block 3 and the irradiation front line tube-supporting block 4 of the functional gripper are connected through tightening screws 6 and tightly grip an outer wall of the ultrasonic irradiation receiver which requires processing. Two tightening screws 6 could be used on a left side and a right side of the functional gripper, with one screw at one side. This kind of disposition specifically in respect of additional features coupled to a conventional apparatus is beneficial to the improvement and modification of operation since only an assembly between the irradiation front line shaft-approximal block 3 and the irradiation front line tube-supporting block 4 assembled by two tightening screws 6 is required at a selected position on the ultrasonic irradiation receiver in use. For some other additionally disposed apparatus, specifically those clamping apparatus fitted onto a small ultrasonic irradiation receiver (diameter: 5-150 mm), use of one tightening screw 6 as illustrated in FIGS. 12-16 should be sufficient.

Figure 17:
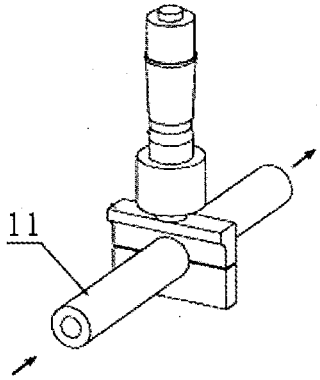
FIG. 17 is a structural view illustrating an application of the clamp type ultrasonic processor of the present invention on an ultrasonic irradiation receiver.

As shown in FIG. 17, a suitable type of functional gripper is used for clamping a tubular ultrasonic irradiation receiver 11. However, some ultrasonic irradiation receivers 11 holding liquid phase materials may not adopt a tubular shape. Instead, they may adopt a rhombus shape, oval shape, triangular shape or polygonal shape etc. Therefore, chambers in shapes that match perfectly with those ultrasonic irradiation receivers for tight clamping effect have to be made. Nevertheless, designs of the functional gripper should comply with the principle of prioritizing resonance. As shown in FIGS. 12-16, the functional gripper chamber formed inside the functional gripper could adopt a rectangular shape, a circular shape, an oval shape or a triangular shape etc. according to the shape of ultrasonic irradiation receiver being clamped, in order to satisfy the need of ultrasonic irradiation receivers in different shapes.

Figure 8:
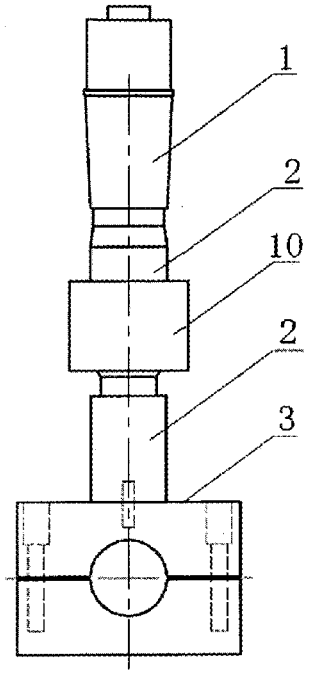
FIG. 8 is a structural view showing an embodiment of the present invention in which the clamp type ultrasonic processor of the present invention has two amplitude transformation shafts.
Figure 9:
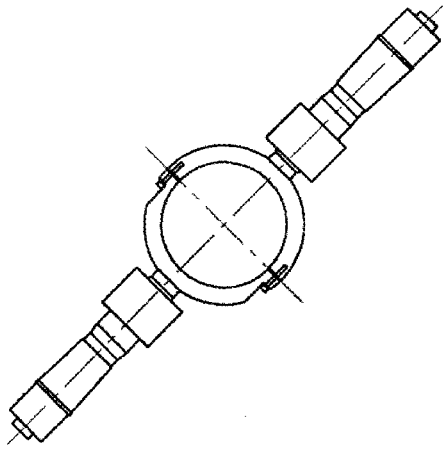
FIGS. 9-10 are structural views showing configuration of two or more sets of transducer assemblies on a functional gripper of the clamp type ultrasonic processor according to the present invention.
Figure 10:
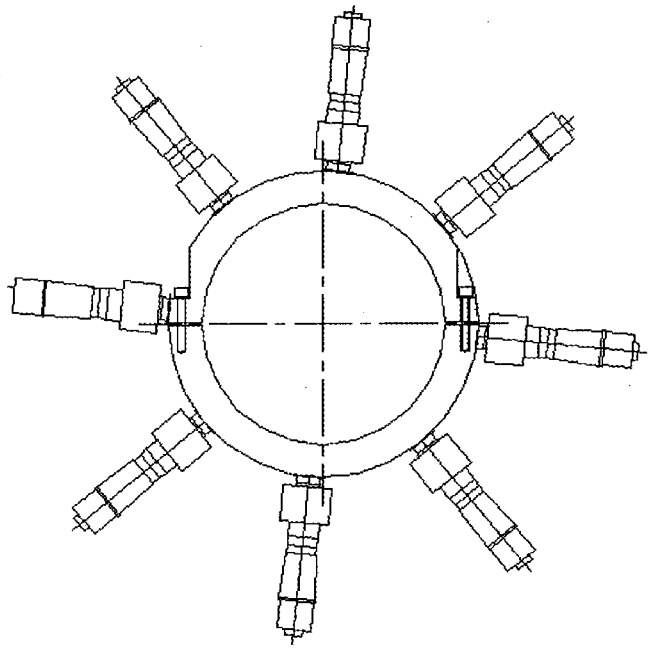

Two or more amplitude transformation shafts 2 could be provided. The amplitude transformation shafts 2 are connected with one another by tightening screws. A flange 10 could be used at a connecting part between two amplitude transformation shafts 2 for consolidation purpose. As shown in FIG. 8, after two amplitude transformation shafts 2 are connected by a tightening screw, a connecting part between the amplitude transformation shafts 2 is provided with a flange 10 for consolidation purpose, and the amplitude transformation shafts 2 are then connected to a functional gripper through a tightening screw.

Figure 11:
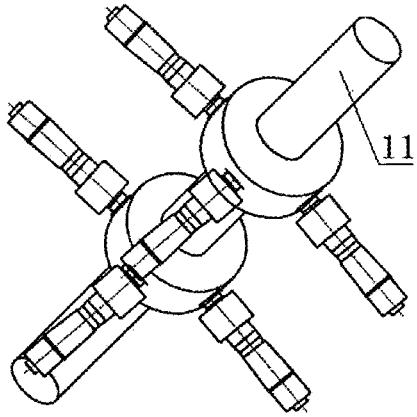
FIGS. 11 and 18 are structural views of an embodiment showing a plurality of the clamp type ultrasonic processors according to the present invention configured on an ultrasonic irradiation receiver.
Figure 12:
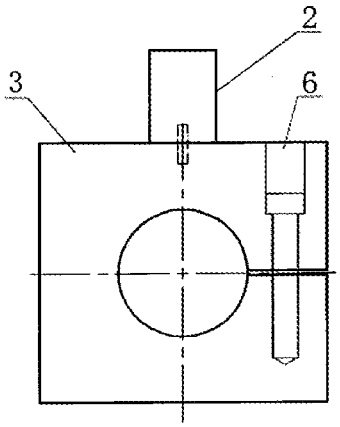
FIGS. 12-16 illustrate different connecting structures of a functional gripper of the clamp type ultrasonic processor according to the present invention, and illustrate different shapes of a functional gripper chamber inside the functional gripper.
Figure 13:
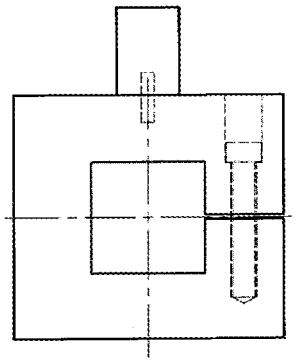
Figure 14:
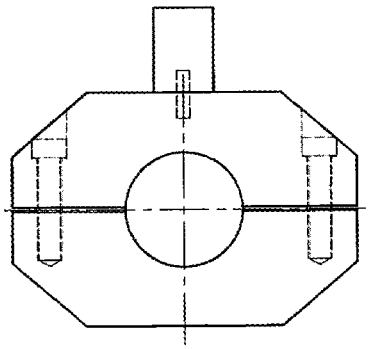
Figure 15:
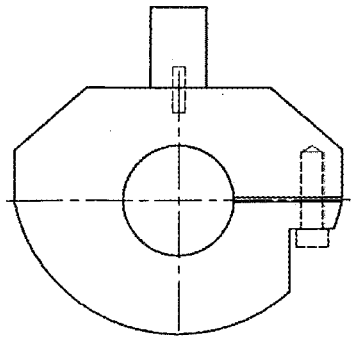
Figure 16:
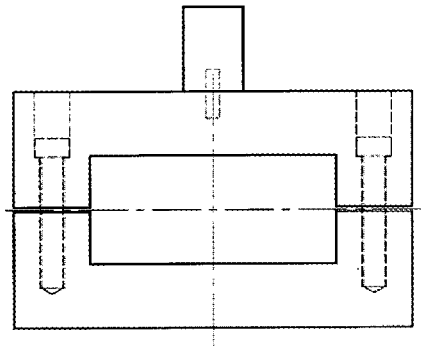
Figure 18:
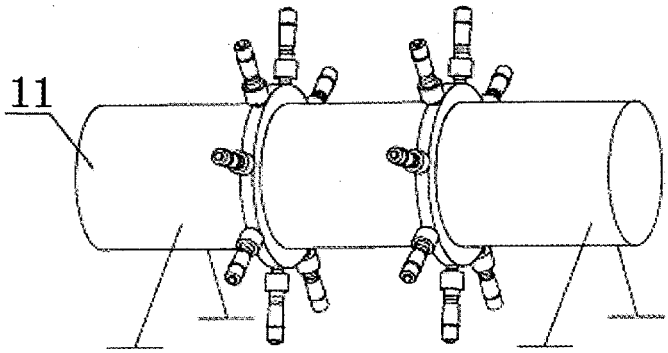

As shown in FIG. 18, when the size of an ultrasonic irradiation receiver is relatively large and therefore a single set of transducer assembly on the functional gripper could no longer satisfy the need of ultrasonic processing, two or more sets of transducer assemblies could be provided at the irradiation front line shaft-approximal block 3 and the irradiation front line tube-supporting block 4 on the functional gripper, and they could be configured symmetrically or asymmetrically, as in FIGS. 18 and 11 respectively.

As shown in FIG. 18, one, two or more clamp type ultrasonic processors each comprising two or more transducer assemblies could be provided on an ultrasonic irradiation receiver 11. As shown in FIGS. 11 and 18, on each of the same cross section of an ultrasonic irradiation receiver 11, a clamp type ultrasonic processor having a functional gripper in a ring shape is provided whereas multiple transducer assemblies are provided on each of the ring shaped functional gripper.

Application of the clamp type ultrasonic processor is described below: at least one set of the clamp type ultrasonic processor is provided around a functional gripper chamber in which an ultrasonic irradiation receiver is accommodated. A functional gripper of the clamp type ultrasonic processor clamps on an outer wall of the ultrasonic irradiation receiver. The clamp type ultrasonic processor of the present invention could treat a cylindrical tank of the existing conventional supercritical extraction apparatus as a tubular ultrasonic irradiation receiver and arrange the clamp type ultrasonic processors to be mounted in an orderly manner at an outer wall of such supercritical cylindrical tank, as illustrated in FIG. 18, so that ultrasonic irradiation and supercritical function are adducted and collaborated to act synchronously upon extraction material. A kind of improved and inventive solution with technical advancement and modification has been therefore undoubtedly attained.

Figure 19:
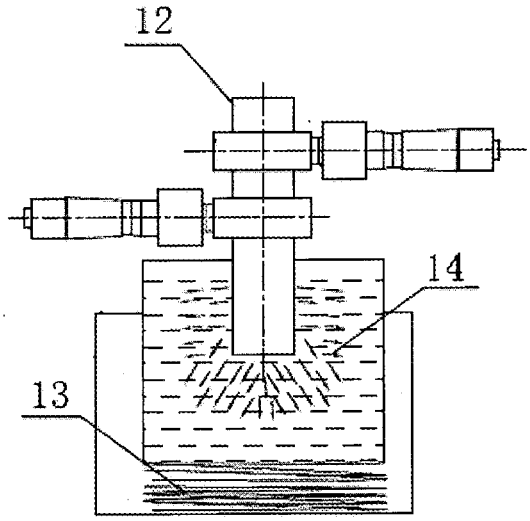
FIG. 19 is a structural view illustrating an application of the clamp type ultrasonic processor of the present invention during metal production.

An application of the clamp type ultrasonic processor in metal production is described below: as shown in FIG. 19, a graphite rod 12 is used as a transfer agent of ultrasonic waves. At least one set of the clamp type ultrasonic processor is provided on the graphite rod 12. A functional gripper of the clamp type ultrasonic processor clamps at an outer wall of the graphite rod 12. One end of the graphite rod 12 is immersed into molten metal liquid phase 14. The molten metal liquid phase 14 is heated in an electrical heating and heat preservation furnace. Electrical heating pipes 13 are provided in the electrical heating and heat preservation furnace for heating up the molten metal liquid phase in the furnace. Ultrasonic irradiation of the molten metal liquid phase in the furnace through the graphite rod 12 could effectively induce crystallization, facilitate and enhance metal properties and could also be used to prepare materials such as alloys.

The clamp type ultrasonic processor of the present invention has the following advantages and scopes of applications:

1. The existing direct immersion type of ultrasonic processor immerses directly into material being acted upon. Therefore, when this kind of processor is used in liquid phase material, metal particles of an immersed portion of the processor will diffuse into the material and therefore pollute the material. On the contrary, the present invention does not have the same problem because ultrasonic irradiation of the present invention is transmitted to the material under separation of the processor and the material by an outer wall of a container.

2. The present invention benefits clamp type and tubular type external installations since it is obviously convenient to install and highly adaptable to existing apparatus for technical improvement and modification. Furthermore, installation of the present invention causes less steric hindrance, resulting in more flexible use of space.

3. The present invention produces good effect when it is applied to plastic extrusion machines or injection molding machines.

4. The present invention could be applied to ultrasonic vibration of thick liquid materials to speed up homogenization, refinement and dispersion, so that these materials for coating apparatus become smooth and flat. Application of the present invention particularly in respect of preparation of thick liquid coating materials for positive and negative terminals of batteries is very effective, and thus improving the craftsmanship thereof.

5. Application of the present invention in respect of preparing bio-diesel could facilitate transesterification, reduce by-products, and alleviate the pressure from the demand for processing procedures such as separation and gasification etc. of materials at a downstream portion of a manufacturing process. As such, the percentage of material utilization increases.

6. Application of the present invention in respect of ultrasonic wine aging could facilitate the wine to meet a target standard quickly and effectively.

7. Application of the present invention in respect of ultrasonic extraction of Chinese medicine could speed up extraction of effective ingredients from plants and animal bodies for medicinal and health care uses. Compared with ultrasonic extraction in a form of cleaning trough, a better extraction effect could be attained by using the present invention.

8. Application of the present invention in wood-plastic composite industry has excellent effect on removing organic materials such as protein, pectin, oligosaccharides and esters in powder of natural fillers such as wood powder and bamboo powder.

9. Application of the present invention has excellent effect on inactivating organisms such as rupturing of plant cells, rupturing of Ganodorma Lucidum (Lingzhi) spores, terminating living cyanobacteria (blue-green algae) and microorganisms. The present invention could also be used for inactivating organisms in ballast water of a vessel.

10. Application of the present invention in respect of sewage treatment combined with the use of ultraviolet and nano $T_iO_2$ (titanium dioxide) solid catalyst could lead to quick reaction, degradation, chain scission, and molecular isomerization etc. of pollutant particles until hydrolysis chemical reaction occurs quickly to achieve water purification. The present invention could also be used for killing germs, virus, harmful micro-organisms, and anthrax virus in mails, and it could also be used for environment sanitization and for eliminating bad odor in air for purification and sanitization of air.

11. The present invention could be applied to induce crystallization. Ice making in a quick and direct manner by using ultrasonic wave has a prospect towards practicability. It also has a promising prospect for inducing crystallization in hydrate.

12. The present invention used together with a graphite rod for ultrasonic irradiation towards a tank of molten metal liquid phase through the graphite rod could effectively induce crystallization and facilitate and enhance metal properties. The present invention is also an effective means for preparing materials such as alloys.

13. Application of the present invention in respect of water activation could cut off hydrogen bond in a water particle having a long chain. The water particle having a long chain then changes its composition and transforms into an active state having a shorter chain. This kind of activated water is a very good kind of healthy activated drinking water.

What is claimed is:

1. A clamp type ultrasonic processor comprising a transducer assembly and a functional gripper, characterized in that the transducer assembly comprises a transducer and an amplitude transformation shaft; the transducer and the amplitude transformation shaft are connected with each other; and at least one set of the transducer assembly is used and connected with the functional gripper; the functional gripper comprises an irradiation front line shaft-approximal block and an irradiation front line tube-supporting block; a functional gripper chamber is formed inside the irradiation front line shaft-approximal block and the irradiation front line tube-supporting block for accommodating an ultrasonic irradiation receiver; the irradiation front line shaft-approximal block and the irradiation front line tube-supporting block connect with each other to grip tightly the ultrasonic irradiation receiver that requires irradiation; the irradiation front line shaft-approximal block and/or the irradiation front line tube-supporting block is/are connected with the amplitude transformation shaft.

2. The clamp type ultrasonic processor as in claim 1, characterized in that the amplitude transformation shaft and the irradiation front line shaft-approximal block are connected via a connection screw.

3. The clamp type ultrasonic processor as in claim 2, characterized in that the irradiation front line shaft-approximal block and the irradiation front line tube supporting block are connected and fixed with each other via at least one screw.

4. The clamp type ultrasonic processor as in claim 1, characterized in that the functional gripper chamber formed by the irradiation front line shaft-approximal block and the irradiation front line tube-supporting block contacts tightly with an outer wall of the ultrasonic irradiation receiver.

5. The clamp type ultrasonic processor as in claim 1, characterized in that a connecting part between an irradiation front line shaft-approximal block and the amplitude transformation shaft adopts a flat, raised or sunken shape.

6. The clamp type ultrasonic processor as in claim 1, characterized in that two or more of the amplitude transformation shafts are provided; a screw is provided for connection between two amplitude transformation shafts; and a flange is also provided at a connecting part between two amplitude transformation shafts for consolidation purpose.

7. The clamp type ultrasonic processor as in claim 1, characterized in that the functional gripper adopts a rectangular shape, a circular shape, an oval shape or a triangular shape; a functional gripper chamber formed inside the functional gripper adopts a rectangular shape, a circular shape, an oval shape or a triangular shape according to the shape of an ultrasonic irradiation receiver being clamped.

8. An application of a clamp type ultrasonic processor, characterized in that at least one clamp type ultrasonic processor Is provided on an outer wall of an ultrasonic irradiation receiver that requires ultrasonic processing; and a functional gripper chamber formed by a functional gripper of the clamp type ultrasonic processor is clamped against an outer wall of the ultrasonic irradiation receiver to be processed by ultrasonic irradiation.

9. An application of a clamp type ultrasonic processor in metal production, characterized in that a graphite rod is used as a transfer agent of ultrasonic waves; one end of the graphite rod is immersed into molten metal liquid phase; at least one of the clamp type ultrasonic processor is provided on the graphite rod; and a functional gripper of the clamp type ultrasonic processor clamps at an outer wall of the graphite rod.

* * * * *